United States Patent [19]

Moriyama

[11] 4,179,876

[45] Dec. 25, 1979

[54] DIGITAL CLOCK FOR MOTOR VEHICLES

[75] Inventor: Masakazu Moriyama, Toyota, Japan

[73] Assignee: Toyota Jidosha Kogyo Kabushiki Kaisha, Toyota, Japan

[21] Appl. No.: 832,549

[22] Filed: Sep. 12, 1977

[30] Foreign Application Priority Data

Nov. 22, 1976 [JP] Japan ..... 51-140374
Feb. 10, 1977 [JP] Japan ..... 52-13645

[51] Int. Cl.[2] ..... G04C 17/00; G04C 19/00; G04C 23/00

[52] U.S. Cl. ..... 58/50 R; 58/23 R; 58/33

[58] Field of Search ..... 58/50 R, 23 R, 33; 340/52 F; 307/10 R, 10 BD, 10 LS, 114

[56] References Cited

U.S. PATENT DOCUMENTS

| | | | |
|---|---|---|---|
| 3,747,323 | 7/1973 | Eckenrode | 58/50 R |
| 3,769,519 | 10/1973 | Adamian | 307/10 LS |
| 3,798,500 | 3/1974 | Florence et al. | 307/10 LS |
| 3,903,513 | 9/1975 | Green | 340/52 F |
| 4,022,017 | 5/1977 | Aoki et al. | 58/50 R |

*Primary Examiner*—B. Dobeck
*Assistant Examiner*—Forester W. Isen
*Attorney, Agent, or Firm*—Koda and Androlia

[57] ABSTRACT

A digital display clock for motor vehicles having a clock driving section for generating time signals continuously regardless of the on or off state of an ignition switch and a digital time display section consisting of an electric current consuming type luminescent element for displaying prescribed digital time. The display action of the digital time display section is controlled by both a main switch means and an auxiliary switch means connected in parallel with each other.

2 Claims, 5 Drawing Figures

DIGITAL CLOCK FOR MOTOR VEHICLES

BACKGROUND OF THE INVENTION

1. Field of Invention

This invention relates to a digital display clock for motor vehicles and in particular to digital type clock for motor vehicles which utilizes luminescent elements with large electric current consumption as the time display.

2. Description of the Prior Art

Since vehicle passengers must be able to read the time quickly and easily while driving a motor vehicle, a digital type display clock finds particular utility. The digital display clock for motor vehicles works such that the display section receives time signals from means for generating time signals. Among the various elements available for the digital time display section, such as luminescent diodes, fluorescent display tubes, liquid crystals, etc., the luminescent diodes and the fluorescent display tubes have excellent characteristics such as emission of visible light through the excitation luminescence action, strong brightness for easy reading, etc., when compared with non self-luminescent elements, liquid crystals, for example. However, the self-luminescent type digital element mainly falls into a luminescent element category of the current drive type, and requires very large electric current comsumption for continuous display action. In particular, since electrical power for a clock for a motor vehicle is always supplied by the battery, which is maintained in good capacity through the charging action at a motor vehicle in operation, large electric current consumption when the engine is not running causes an objectionable drain of the battery.

A typical conventional digital display clock for motor vehicle is equipped with clock driving section wherein electric current is always supplied, and with digital time display section wherein electric current supply is controlled by a switch interlocked to the ignition switch. The digital time display action can be obtained only when the motor vehicle is in operation. The increase of electric current consumption is thus prevented. Furthermore, the prior art circuit has another drawback in that troublesome ignition key switching is always required to read the time when parking the motor vehicle. In particular, one staying in the motor vehicle is unable to know the time without an ignition key, and it is extremely dangerous for the one without driving competance of motor vehicles to switch on the ignition switch in order to try to read the time.

SUMMARY OF THE INVENTION

Accordingly, it is the general object of the present invention to provide a digital display clock for a motor vehicle in which the digital time display can be optionally performed in necessity.

In keeping with the principles of the present invention, the object is accomplished with a unique digital display clock for a motor vehicle including an auxiliary switch means connected in pallarel with the main switch which is placed between digital time display section and battery, and including supplying means for momentarily supplying current from battery for the digital time display section by operation of auxiliary switch means even when the main switch is off.

BRIEF DESCRIPTION OF THE DRAWINGS

The above mentioned and other features and object of the present invention will become more apparent by reference to the following description taken in conjunction with the accompanying drawings, wherein like referenced numerals denote like elements, and in which.

DETAILED DESCRIPTION OF THE INVENTION

Figure 1:
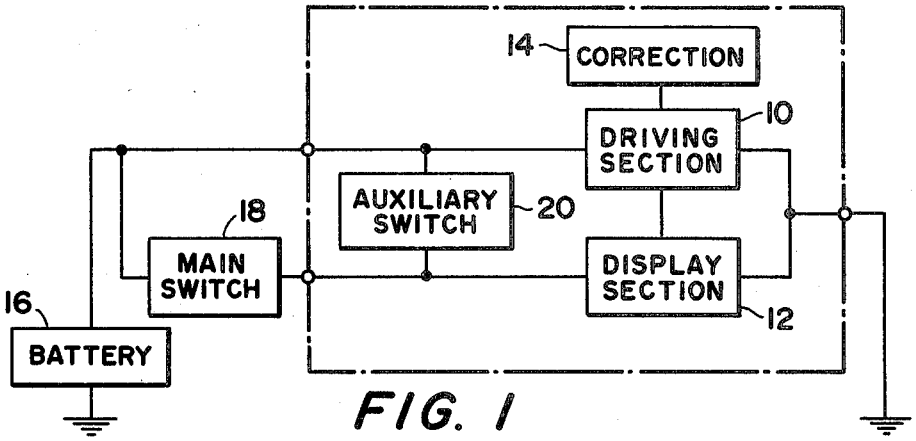
FIG. 1 is a block diagram of a preferred embodiment in accordance with the teachings of the present invention.

Referring more particularly to the drawings, shown in FIG. 1 is a preferred first embodiment in accordance with the teachings of the present invention. In FIG. 1, a clock driving section 10 having a means for generating time signals in its inside such as crystal oscillator, etc. divides high frequency oscillation pulse signals from the oscillator into suitable frequencies, and transforms the divided time signals via well-known matrix circuit into hour, minute, second, and date signals. The outputs of the clock drive section 10 are supplied to the respective luminescent display elements located in a digital time display section 12 for displaying the time on the basis of afore-mentioned time signals. The display elements of digital time display section 12 are made up of excitaion luminescent bodies, for example, luminescent diodes, fluorescent display tubes, etc., and respective numerals and letters are composed of plural display elements. The clock driving section 10 is coupled to a correction circuit 14 in order to perform a time correction action by suitable correcting switch operation. The clock driving section 10 is directly connected to a battery 16 and is always supplied battery current so that the crystal oscillator and the frequency dividing circuit can be kept in operation to feed time signals from the driving section 10 to the digital time display section 12. On the other hand a main switch 18 is installed between the digital time display section 12 and the battery 16 to control the electric current supply to the digital time display section 12. The switch 18 consists of an on and off switch which is interlocked to the ignition switch and the switch 18 is in the on state to feed the electric current to the digital time display section 12 from battery 16 when the ignition switch is turned on or is set in the accessory position by the ignition key of the motor vehicle. Therefore, the digital clock display section 12 works with motor vehicle in motion, with running engine or in the supplying state of the electric current to automobile accessories by the ignition switch. In the other state, the display function is not activated since the switch 18 is in the off position and hence, no electric current supply to the digital time display section 12 from battery 16 takes place. Accordingly, unnecessary electric current consumption of battery is prevented.

The present invention is characterized by an auxiliary switch means 20 which is coupled in parallel with the afore-mentioned main switch 18. The auxiliary switch means 20 is normally in the off position but anyone in the motor vehicle can switch it on at any time, and then the electric current is fed into the digital display section 12 from battery 16 through the auxiliary switch means 20 even if the main switch 18 is in the off position. As above described, the present invention has the advantage of reading the time by switching on the auxiliary switch means even if the main switch 18 is in the off position, and the present invention provides the extreme improvement in the operation in comparison with the operation by conventional ignition key switching.

The auxiliary switch means 20 can include a push-button switch installed in the passenger compartment of motor vehicle. The time can be read while the auxiliary switch means is turned on by pushing the push-button switch. The push-button switch returns to off state upon release of pushing the button so that the electric current supply is cut off soon after finishing the time reading. Thus, the electric current consumption of battery can be minimized.

The auxiliary switch means 20 may be composed of a switching circuit with automatic reversion to off position after pushing on the switch and continuing the on state for a certain time. Accordingly, a saving of electric current consumption can be achieved by automatically switching off the digital time display after enough seconds of reading the time even if one pushes on and leaves the switch in the on position for a while. Shown in FIG. 2 and FIG. 3 are second and third embodiments of a digital clock including the afore-described auxiliary switch means with a timer function in accordance with the teachings of the present invention.

Figure 2:
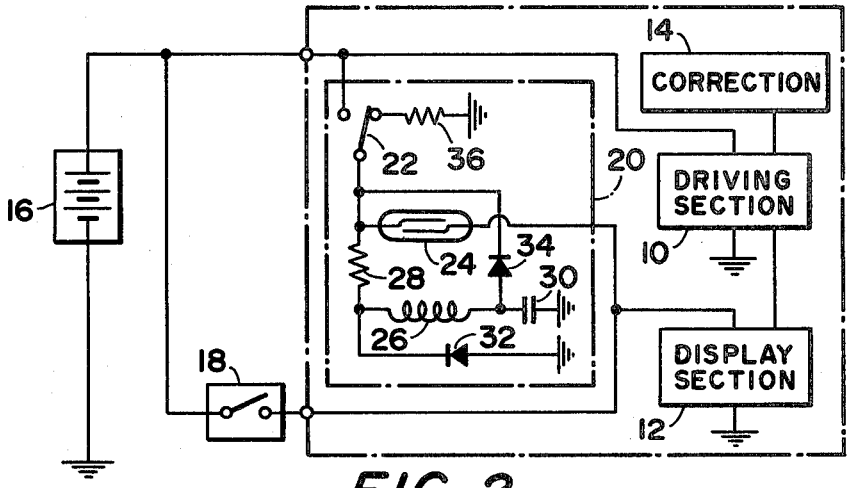
FIG. 2 is a circuit diagram of a second embodiment in accordance with the teachings of the present invention.

Referring to FIG. 2, shown therein is a second embodiment of a digital display clock in accordance with the teachings of the present invention. Since the embodiment of FIG. 2 is similar to the embodiment of FIG. 1 in many respects, common elements in FIG. 2 are given like reference numerals and an explanation of their interconnection and operation will be omitted. In FIG. 2, the electric current to the time display section 12 from battery 16 is supplied through a manipulation switch 22 and a lead switch 24. An excitation coil 26 is provided adjacent the switch 24 in order to turn on and off the switch. One end of the coil 25 is though one fails to turn off the lead switch 24 is turned on only during the charging period when the charging current to the condenser 30 is fed to the coil 26. The exciting period of coil 26 is substantially determined by the capacity of condenser 30, the combined resistance value of the coil 26 and the resister 28, and the applied voltage. As shown in FIG. 2, the voltage applied to the coil 26 is substantially kept stable even if the voltage of battery 16 varies, since the Zener diode 32 is coupled to the resister 28, and as the consequence the exciting period of coil 26, that is, the displaying period of digital time display section 12 is substantially stable. Consequentially, even though one fails to turn off the switch 22, the electric current supplied from battery 16 is automatically cut off, and an unnecessary digital time display as well as an increase of consumable electric current are completely avoided. When one turns off the switch 22 as shown in FIG. 2, the electric charge of condenser 30 is discharged by way of the diode 34, the switch 22 and the resister 28, and smaller setting of the value of the resister 36 than the combined resistance value of the resister 28 and the coil 26 can prevent the lead switch 24 from being turned on during the discharge.

Figure 3:
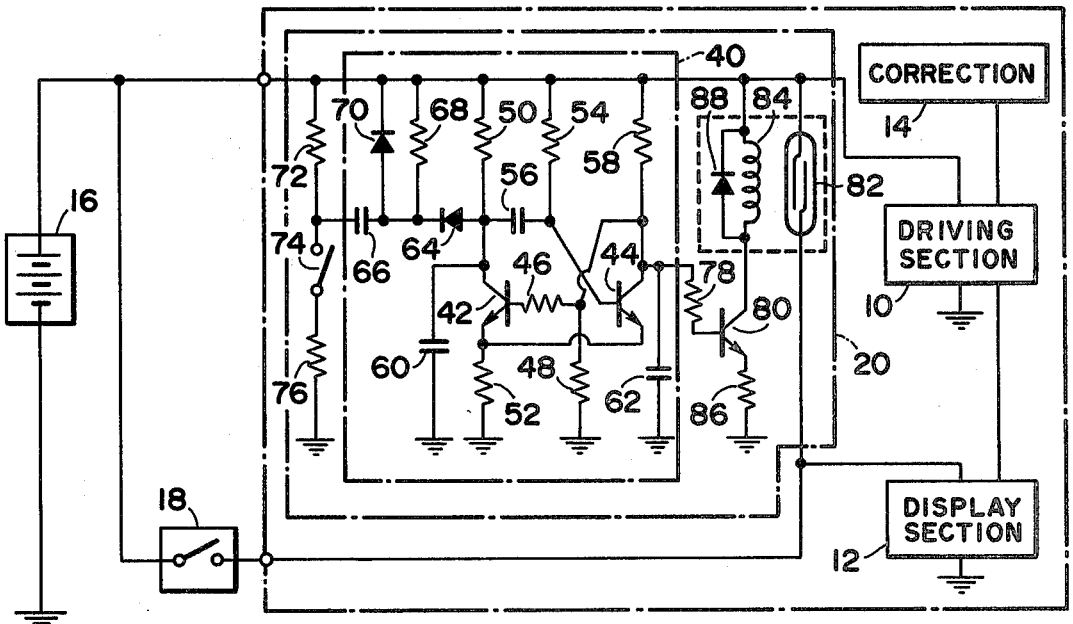
FIG. 3 is a circuit diagram of a third embodiment in accordance with the teachings of the present invention.

Referring to FIG. 3, shown therein is a third embodiment of a digital display clock with timer function in accordance with the teachings of the present invention. Since the embodiment of FIG. 3 is similar to the embodiment of FIG. 1 in many respects, common elements in FIG. 3 are given like numerals and a description of their interconnection and operation will be omitted. In the embodiment of FIG. 3, the timer function is characterized by a monostable multivibrator circuit. The monostable multivibrator circuit 40 includes transisters 42 and 44. The base of transister 42 is coupled with the collector of transister 44 via a resister 46, while one end of resister 46 is grounded by way of a resister 48. The collector of transister 42 is connected to the battery via a resister 50. The emitters of transisters 42 and 44 are combined together, and the combined point is grounded through a resister 52. Input signals are supplied to the collector of transister 42 through a diode 64 and a condenser 66. The parallel circuit of a resister 68 and a diode 70 is placed between the battery and the midjunction point of the diode 64 and the condenser 66. The battery 16 is coupled with the input end of condenser 66 via a resister 72, and the combined point of condenser 66 and resister 72 is connected to one end of manipulation switch 74, while the other end of the switch 74 is grounded by was of a resister 76. The collector of a transister 44 is coupled to the base of a driving transister 80 via a resister 78, and the collector of the transister 80 is connected to the battery 16 through an exciting coil 84 which excites a lead switch 82. The emitter of the transister 80 is grounded via a resister 86, and a diode 88 is coupled in parallel with the exciting coil 84.

The embodiment of FIG. 3 is composed as afore-described and the action is explained in the following. When the manipulation switch is in the off position, the monostable multivibrator circuit 40 is stabilzed at off state of the transistor 42 and at on state of the transister 44. The transister 80, therefore, is at off state and the exciting current is not supplied to the exciting coil 84 so that the lead switch 82 is in the off position. Accordingly, nothing but a main switch 18 controls operation of the digital time display section 12. When the manipulation switch 74 is turned on at this state, the current supply to the base of transister 44 is cut off, as known well, to have the transister 44 put in the off state whereas the transister 42 is put in the on state. Therefore, the off state of the transister 44 supplies the electric current to the base of the driving transister 80, while the on state of transister 80 excites the exciting coil 84 so that the lead switch 82 is turned on. The monostable multivibrator circuit 40 is again inverted to turn the transister 42 into the off state after a predetermined period of operation, and the transister 44 turns into the on state so that the driving transister 80 returns to the off state. During the set-up time the digital time display section 12 works to display the time and it can be read by vehicle passengers.

As is evident from the embodiments of FIG. 2 and FIG. 3, the present invention provides a practical advantage in that the addition of timer function makes it possible to activate a digital time display very easily, and to be able to know the time in the compartment of motor vehicle at any time without continuous pushing of the push-bottom switch but by a simple switching action.

Figure 4:
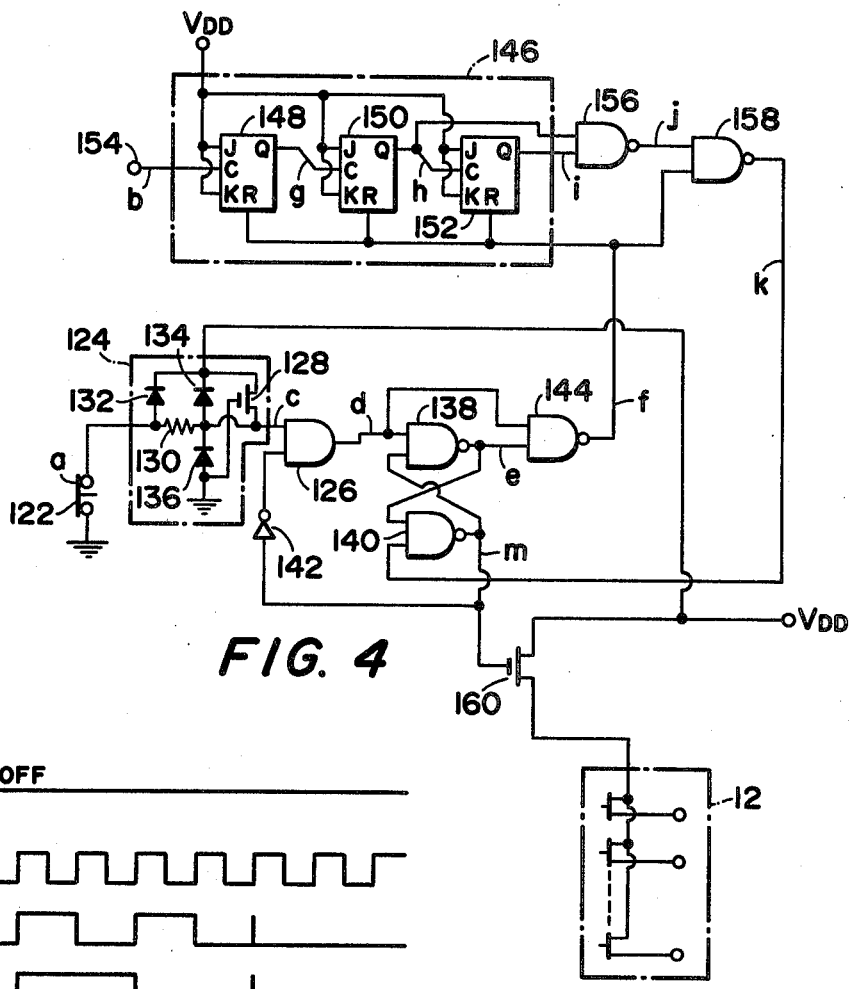
FIG. 4 is a circuit diagram of a fourth embodiment in accordance with the teachings of the present invention.
Figure 5:
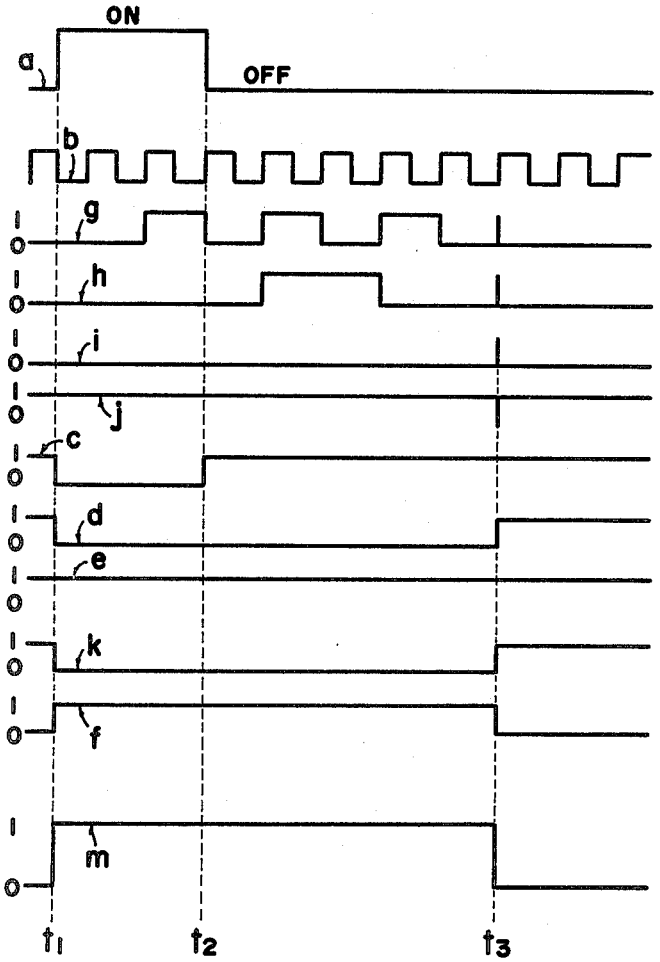
FIG. 5 is a wave form chart of FIG. 4.

Referring to FIG. 4, shown therein is a fourth embodiment of a digital display clock including the auxiliary switch means with timer circuit in accordance with the teachings of the present invention, and description is made with reference to the time chart of FIG. 5 showing the working condition of various points of the circuit illustrated in FIG. 4.

The auxiliary switch means includes a manipulation switch 122 placed in the compartment of motor vehicle and this switch is turned on by a pushing action.

The one end of the manipulation switch 122 is connected to the one end of an NAND gate 126 through a serge absorbing circuit 124. The serge absorbing circuit 124 includes a MOS FET 128, a resister 130 diodes 132, 134, and 136 to return an impulse current rise from accumlated static charges or something else to the power source $V_{DD}$. The output of NAND gate 126 is connected to the one end of a NAND gate 138 which forms a flip-flop, and the output of the other NAND gate 140 forming the flip-flop is coupled with the other end of input terminal of NAND gate 126 via a NOT gate 142. The output of NAND gate 138 is connected to the input terminal of a NAND gate 144 together with the output of NAND gate 126, while the output terminal of NAND gate 144 is coupled to the reset terminal of three flip-flops 148, 150 and 152 which constitute a counter 146 of a timer circuit. In the illustrated embodiment, the counter 146 is formed by three-state JK flip-flop binary counter, and the generated clock pulse is supplied through the input terminal 154 to the C terminal of first state flip-flop 148. In the illustrated embodiment, the generated clock pulse is formed by a pulse signal of one hertz frequency obtained from clock driving section 10 in FIG. 1. The output terminal Q of flip-flop 148 in the first stage is coupled to the C terminal of flip-flop 150 in the second stage, and the output terminal Q of flip-flop 150 is connected to the C terminal of flip-flop 152 in the third stage. The outputs of flip-flop 150 and 152 are coupled with the input terminal of NAND gate 156, while the output of NAND gate 156 is connected to the input of NAND gate 158. The output of NAND gate 158 is coupled with the other end of the input of NAND gate 140 which forms the flip-flop, and the output of NAND gate 140 is connected to MOS FET 160. The output of MOS FET 160 is connected to plural FET drive circuits which drive the each elemt of the digital time display section 12, and each display element is driven and controlled by MOS FET 160.

The fourth embodiment of the present invention with the above described configuration works as follows. In the time chart of FIG. 5, the on and off action of manipulation switch 122 is shown as signal "a", and the generated clock pulse supplied to the input terminal 154 of counter 146 is shown as "b".

At the time of $t_1$, the manipulation switch is manually turned on. As a consequence, the one end of input terminal of NAND gate 126 is inverted from "1" to "0" as shown "c" of FIG. 5. Therefore, the output of NAND gate 126 turns into "0" and the output e of NAND gate 138 is retained "1". The impression of the signals "d" and "e" changes the output of "f" of NAND gate 144 into "1", and switches the counter of each flip-flop 148, 150, 152 from the reset position to the set position respectively to start counting action. As already known, the counter 146 consists of the binary counter and the output "g", "h" and "i" of each flip-flop 148, 150 and 152 performs a frequency dividing action respectively as shown in the time chart of FIG. 5. During the counting action, NAND gate 156 puts out a "1" stay "0". Consequently, the output "k" of NAND gate 158 turns into a "0", while the output "m" of NAND gate 140 becomes a "1". The output of NAND gate 140 is supplied to MOS FET 160 as as signal "m", and the signal "m" changes from a "0" to a "1" with the on action of the switch 122 as afore-described so that a digital display section 12 performs digital time display action.

At the time of $t_2$, an off action of switch 122 by an operator changes the signal "c" into "1" signal. In the present invention, the switch 122 consists in an ordinary push-button switch whose contact is on only during the push action. Therefore, the instantaneous on action of manipulation switch 122 gives the afore-described output "m", and the digital time display is continuously performed in spite of the off position of the switch 122 since the inverted signal of signal "m" inverted by NOT gate 142 is supplied to the one end of input terminals of NAND gate 126 as "0" signal, even though the off returning switch 122 changes the one input "c" of NAND gate 126 into "1", and the output "d" of NAND gate 126 still stays at "0" signal state.

As described in the above, the digital display action 12 performs a digital time display through the on action of switch 122. During the display, the counter 146 performs the counting action in accordance with the one hertz clock pulse, and, at the time of $t_3$, both outputs "h" and "i" of flip-flop 150 and 152 are changed into a "1" signal, while the output "j" of NAND gate 156 turns into a "0" signal. Since the invertion of signal "j" changes the output "k" of NAND gate 140 is inverted from a "1" to a "0". Consequently, the digital time display is released and the digital time display section 12 stops working. Since the signal "m" inverted by NOT gate 142 is supplied to NAND gate 126, and one input "c" of NAND gate 126 has already turned into a "1" signal, the output "d" of NAND gate 126 becomes a "1" signal. As a consequence, the output "f" of NAND gate 144 is changed into a "0" signal and stops the counting action of counter 146.

Since, in the illustrated embodiment, a clock pulse having one hertz frequency is supplied to the counter 146 consisting of three-stage flip-flop binary counter, a "1" signal period of the output "m", that is, the digital time displaying period, is set for eight seconds. However, the displaying time has a deviation of one second at maximum in relation to the on action time of switch 122 and the phase of clock pulse "b", and it is understood that the time is practically selected between seven seconds and eight seconds. The digital display time can be set as desired by selecting the composition of counter 146 or the input pulse cycle to counter 146. In the illustrated embodiment, the on action of manipulation switch starts the counting action of the counter 146, but it may be also possible to start the counting action at the time of switch off after the on action of manipulation switch 122 to perform the displaying action and to stop displaying after a prescribed time.

As for the auxiliary switch means, it may be also possible to use a seat switch operated when a passenger is seated in the compartment of motor vehicle or a door switch operated when he opens and closes the door to display the time automatically for a prescribed time after the switch operation without the manipulation switch required as illustrated.

According to the preceding, the present invention provides an operationally effective digital display which is suitable for any motor vehicle digital clock. The present invention also provides the advantages of consuming less electric current of the battery and of displaying the time at any time with a digital type clock for motor vehicle. In all cases it is understood that the above described embodiments are merely illustrative of but a few of the many possible specific embodiments which represent the application of the principles of the present invention. Numerous and varied other arrangements can be readily devised in accordance with these principles by those skilled in the art without departing from the spirit and scope of the invention.

I claim:

1. A motor vehicle digital display clock comprising:

a clock driving section having means for generating time signals and adapted to send out desired time signals;

a digital time display section having an electric current consuming type luminescent element performing prescribed digital time display in response to said time signals from said clock driving section;

a main switch means consisting of a main switch placed between said digital time display section and a battery, and performing the display action of said digital time display section by on and off action interlocked to an ignition key switching; and an auxiliary switch means for actuating said display action of said digital display section by switching operation of an auxiliary switch connected in parallel with said main switch when said main switch is off, said auxiliary switch means comprising a manipulation switch, a switching element which is normally opened and connected in parallel with said main switch, and a timer circuit which comprises a counter which counts to a prescribed number of said time signals of said clock driving section and which closes said switching element during a prescribed period after a switching operation of said manipulation switch thereby said digital display section performs digital time display.

2. A motor vehicle digital display clock comprising:

a clock driving section having means for generating time signals and adapted to send out desired time signals;

a digital time display section having an electric current consuming type luminescent element performing prescribed digital time display in response to said time signals from said clock driving section;

a main switch means consisting of a main switch placed between said digital time display section and a battery, and controlling the display action of said digital time display section by on and off action interlocked to an ignition key switching; and an auxiliary switch means for actuating said display section of said digital display section by switching operation of an auxiliary switch connected in parallel with said main switch when said main switch is off, said auxiliary switch means comprising a timer circuit which activates said digital display action of said digital time display section of a motor vehicle digital display clock in response to said time signals generated by said clock driving section.

* * * * *